US006704966B1

(12) United States Patent
Kao

(10) Patent No.: US 6,704,966 B1
(45) Date of Patent: Mar. 16, 2004

(54) WATERPROOF HINGE STRUCTURE FOR GLASS DOOR

(76) Inventor: Chin-Min Kao, No. 11-8, Alley 4, Lane 63, Yili St., Taipei City (TW)

( * ) Notice: Subject to any disclaimer, the term of this patent is extended or adjusted under 35 U.S.C. 154(b) by 0 days.

(21) Appl. No.: 10/283,204

(22) Filed: Oct. 30, 2002

(51) Int. Cl.[7] ..... E05D 5/02; E05D 11/10

(52) U.S. Cl. ..... 16/252; 16/382; 16/334; 16/286

(58) Field of Search ..... 16/252, 382, 334, 16/335, 332, 286

(56) References Cited

U.S. PATENT DOCUMENTS 5,297,313 A * 3/1994 Brin ..... 16/252
5,448,799 A * 9/1995 Stein, Jr. ..... 16/225
5,867,869 A 2/1999 Garrett et al.
5,867,871 A * 2/1999 Tasman ..... 16/335
6,070,294 A 6/2000 Perkins et al.
6,161,255 A * 12/2000 Garrett ..... 16/284
6,560,821 B2 * 5/2003 Miller et al. ..... 16/252

FOREIGN PATENT DOCUMENTS

DE 19649352 A1 * 6/1998
EP 0882864 A2 * 12/1998
EP 1319359 A2 * 6/2003

* cited by examiner

*Primary Examiner*—Chuck Y. Mah
(74) *Attorney, Agent, or Firm*—Birch, Stewart, Kolasch & Birch, LLP

(57) ABSTRACT

A waterproof hinge structure for a glass door adopted for use on a shower stall includes a support member and a door clamp means to form a closed and tight contact therebetween to prevent water in the shower stall from splashing or seeping outside the shower stall and keep the surroundings outside the shower stall dry. A pad member is bridged between the support member and the door clamp means to prevent the two from hitting each other so that damaging scratches may be prevented from occurring on the surface of the support member.

6 Claims, 4 Drawing Sheets

WATERPROOF HINGE STRUCTURE FOR GLASS DOOR

FIELD OF THE INVENTION

The present invention relates to a waterproof hinge structure for glass doors and particularly a hinge structure that forms a tight contact between a support member and a door clamp means of a glass door of a shower stall.

BACKGROUND OF THE INVENTION

Glass doors have unique material properties, therefore the commonly used hinges for wooden doors cannot be employed. Many hinge structures have been proposed and developed in the prior art to meet this requirement. For instance, U.S. Pat. No. 5,867,869 entitled "Pressure hinge device for glass door or panel" discloses an apparatus that includes a base plate mounted onto a wall, a glass clamp and a tram body attached to the base plate. The tram body has a main pivot roller which has two ends embedded in the glass clamp. The tram boy further has a plurality of holes each holding a spring pad and a spring which presses the spring pad to the main pivot roller for anchoring. In addition, the main pivot roller is coupled with a washer for fastening to the tram body securely.

Nowadays, the glass doors are widely used in shower stalls. As water tends to splash during shower, the glass doors aim at preventing the splashing water from spreading outside the shower stall. This function is especially important when the shower stall is located inside a room of a building. To satisfy this purpose, U.S. Pat. No. 6,070,294 entitled "Hinge for a shower screen door" discloses an apparatus that has glass clamping parts for holding the glass door and a circular door mounting part. As the door mounting part and the glass clamp parts form a curved surface at the contact portion, and the glass clamp parts and the door mounting part form a plane at the contact portion, the curved surface and the plane form a line contact at the adjoining location. During installation, a slight deviation of accuracy could result in a gap, and water is prone to seep or flow out through the glass door, and the surroundings outside the shower stall could become damp and smeared.

SUMMARY OF THE INVENTION

Therefore the primary object of the invention is to resolve the aforesaid disadvantages. The invention provides a waterproof hinge structure for glass doors to prevent water from seeping outside the shower stall and smearing surroundings outside the shower stall, and to retard rusting of the hinge structure. Another object of the invention is to prevent the glass clamp means and the support member from hitting each other when the glass door is swiveled over 90° and to avoid scratches from occurring on the surface of the support member, thereby to avoid the paint coated on the surface of the support member from peeling off and to prevent rusting or damaging of the aesthetic appeal that might otherwise occurred to the support member.

In order to achieve the foregoing objects, the waterproof hinge structure of the invention consists of an anchor dock fixedly mounted onto a wall with a plurality of holes formed thereon; a support member fastening to the anchor dock that has a pivotal trough formed on one side thereof and anchor apertures formed on another side normal to and communicating with the pivotal trough; a pivotal axle pivotally housed in the pivotal trough having an anchor plane and anchor struts; each anchor aperture housing an anchor element and an elastic element, the anchor element having one end engaged with the hole of the anchor dock; a door clamp means which includes a holding clip with a cutaway notch formed thereon, a clamp clip and two gaskets, the notch has an upper side and a lower side with a trough formed respectively thereon corresponding to each other and a vertical side with a plurality of coupling holes formed thereon, and screw holes formed on an inner side of the holding clip, the clamp clip and two gaskets have apertures formed thereon corresponding to the screw holes for fastening the door clamp means to the glass door; the anchor strut of the pivotal axle is coupled in the trough of the holding clip to enable the glass door and the support member to form a pivotal turning relationship; and a pad element including an arched surface and a plurality of stubs located on the arched surface to engage with the coupling holes, the arched surface having two sides each extends to form a bulged rim. The hinge structure thus constructed can tightly hold the glass door by clamping the glass door securely through the support member and the door clamp means. Therefore water in the shower stall is prevented from splashing or seeping outside the shower stall, and the surroundings of the shower stall may be maintained dry and neat.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
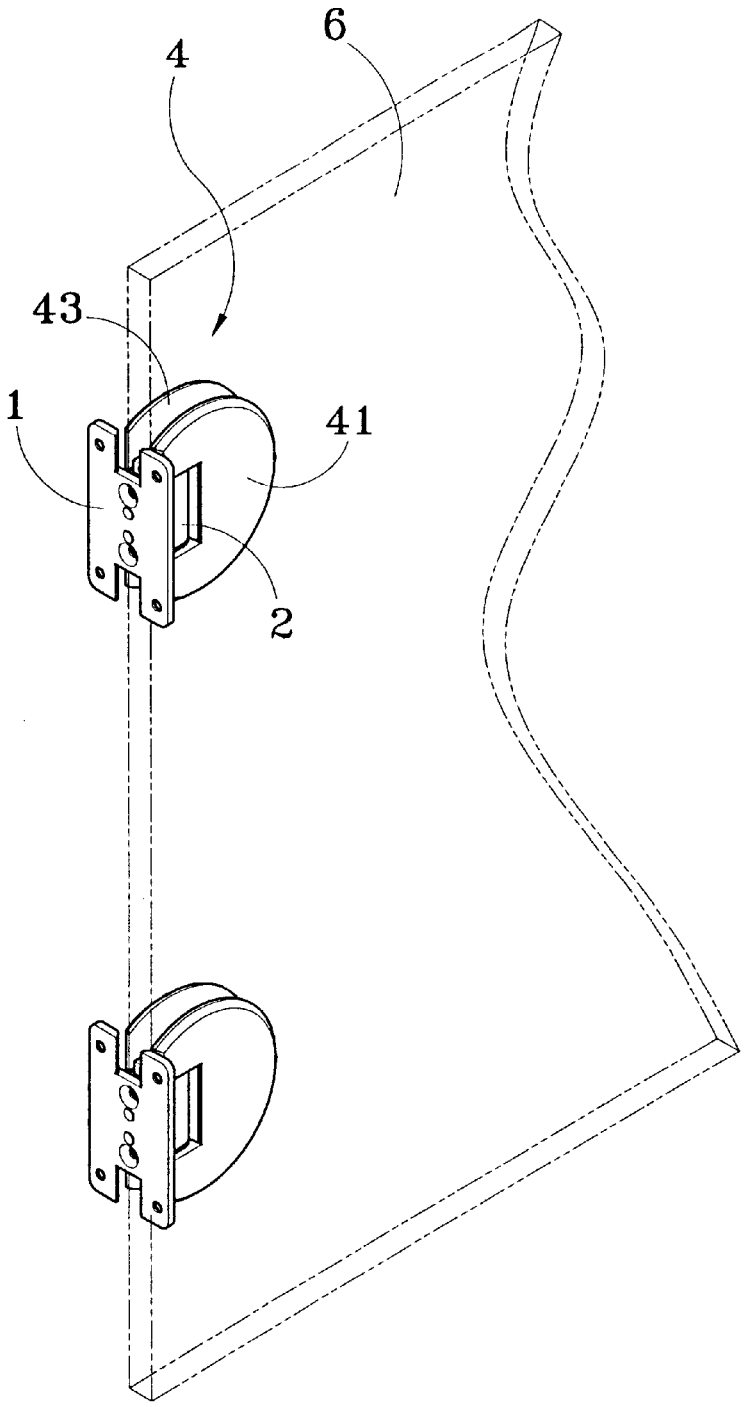
FIG. 1 is a pictorial view of the invention.
Figure 2:
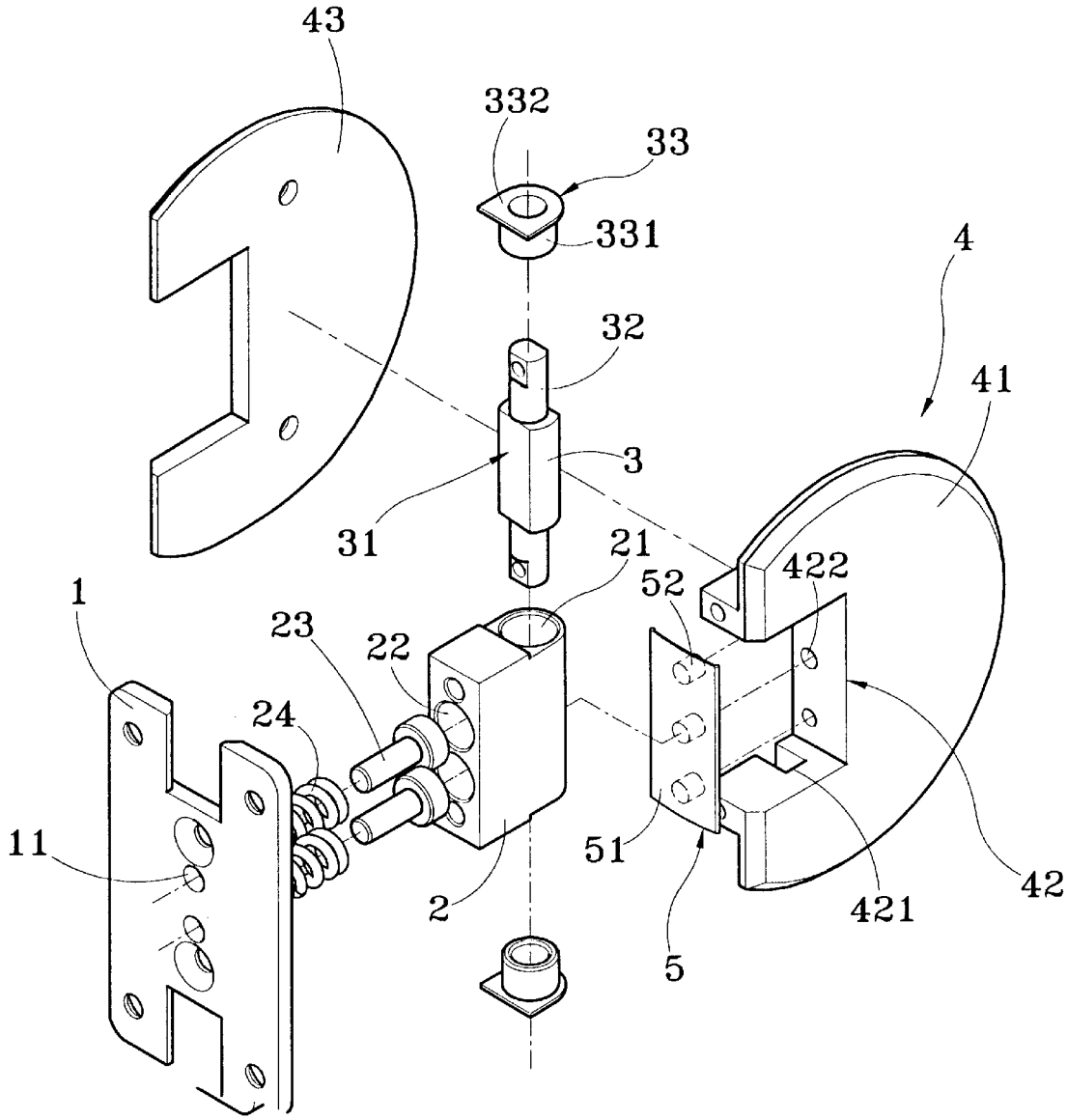
FIG. 2 is an exploded view of the invention.

Referring to FIGS. 1 and 2, the waterproof hinge structure of the invention is located on a glass door 6 of a shower stall. The hinge structure includes an anchor dock 1 fixedly mounted onto a wall, a support member 2 fastening to the anchor dock 1, a pivotal axle 3 pivotally located on one side of the support means 2, and a door clamp means 4 for clamping the glass door 6.

The anchor dock 1 is fixedly mounted onto a wall and has a plurality of holes 11 formed thereon.

The support member 2 is fastened to the anchor dock 1, and has a pivotal trough 21 formed on one side thereof and anchor apertures 22 formed on another side normal to and communicating with the pivotal trough 21. The pivotal trough 21 pivotally houses a pivotal axle 3 which has an anchor plane 31 and anchor struts 32. Each anchor aperture 22 houses an anchor element 23 and an elastic element 24. The anchor element 23 runs through the elastic element 24 and the anchor aperture 22 to press the pivotal axle 3. The anchor plane 31 of the pivotal axle 3 serves anchor finction for the opening or closing of the glass door 6. The support member 2 has another end engaged with holes 11 of the anchor dock 1.

The door clamp means 4 includes a holding clip 41 with a cutaway notch 42 formed thereon and a clamp clip 43. The notch 42 of the holding clip 41 has an upper side and a lower side with a trough 421 formed respectively thereon corresponding to each other and a vertical side with a plurality of coupling holes 422 formed thereon. The troughs 421 of the holding clip 41 may hold the anchor struts 32 of the pivotal axle 3 to enable the glass door 6 and the support member 2 to form a pivotal turning relationship.

Figure 3A:
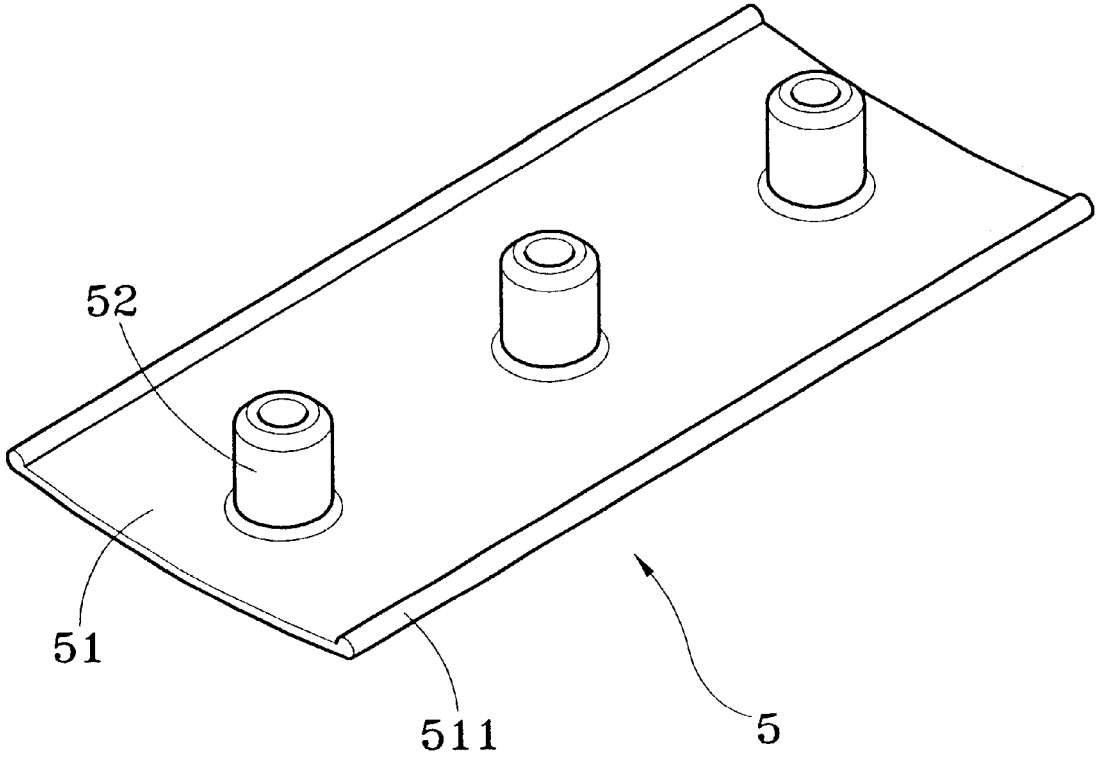
FIGS. 3A and 3B are enlarged fragmentary views of the invention.
Figure 3B:
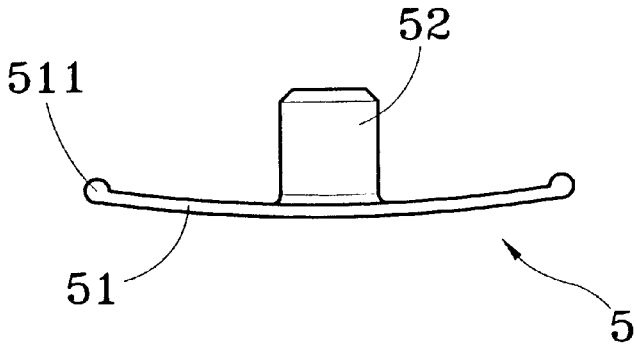

The pad element 5 (referring to FIGS. 3A and 3B) has an arched surface 51 and a plurality of stubs 52 located on the arched surface to engage with the coupling holes 422 of the holding clip 41. The arched surface 51 has two sides each extends to form a bulged rim 511. The pad element 5 is made from an elastic material such as rubber.

The pivotal axle 3 further has two ends adjoining the support member 2. Each end of the pivotal axle 3 at the adjoining portion is coupled with a plug 33 which has a cylindrical hollow shaft 331 and a retaining surface 332 extending from one end thereof. After the shaft 331 is coupled with the pivotal axle 3 and the support member 2, the retaining surface 332 presses the flat surface of the support member 2.

Figure 4A:
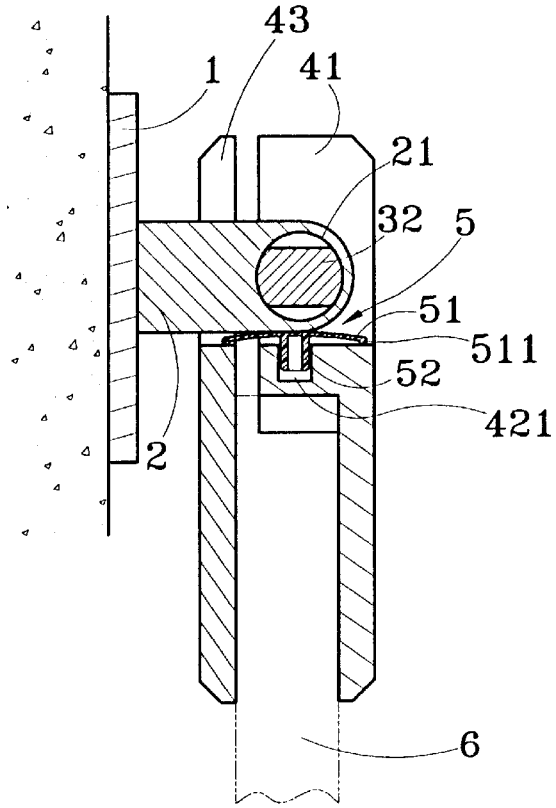
FIGS. 4A and 4B are schematic views of the invention in various use conditions.
Figure 4B:
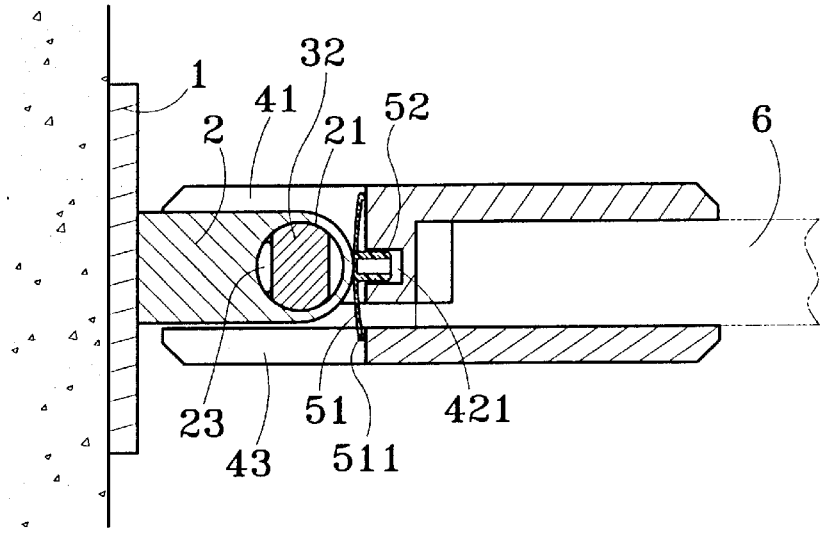

Refer to FIGS. 4A and 4B for the invention in various use conditions. The anchor struts 32 of the pivotal axle 3 are pivotally housed in the troughs 421 of the holding clip 41 of the door clamp means 4 to enable the glass door 6 and the support member 2 to form a pivotal turning relationship so that the glass door 6 may be opened or closed. As the pad element 5 is located on the contact surface between the support member 2 and the door clamp means 4 and is made from an elastic material, and bulged rims 511 form a closed and tight contact with a flat surface of the holding clip 41 and the clamp clip 43, and the arched surface 51 forms a closed contact with the support member 2, the support member 2 and the door clamp means 4 always form a contact surface therebetween. Therefore the elasticity of the pad member 5 always keeps the support member 2 and the door clamp means 4 in closed contact with each other without forming a chink even if a gap is generated during installation or assembly, or the gap increases or decrease during the glass door 6 is opened or closed. Thus water in the shower stall may be prevented from splashing or seeping outside the shower stall, and the surroundings outside the shower stall may be maintained dry and neat.

In addition, the retaining surfaces 332 of the plug 33 press the surfaces of the support member 2, and can effectively prevent water from spilling to the surfaces of the pivotal axle 3 and the pivotal trough 21, therefore rusting of the hinge structure may be retarded, and smooth turning the hinge structure may be maintained.

Furthermore, the pad element 5 is bridged between the support member 2 and the door clamp means 4 to provide a secured support. When the glass door 6 is swiveled exceeding 90°, the door clamp means 4 may be prevented from directly hitting the support member 2. Hence the paint or lacquer coated on the surface of the support member 2 may be prevented from peeling off and rusting may be retarded, and damage of the aesthetic appearance of the support member 2 may be avoided.

What is claimed is:

1. A waterproof hinge structure for a glass door mounted onto a wall adopted for use on a shower stall, comprising:

an anchor dock fixedly mounted onto the wall having plurality of holes formed thereon;

a support member fastened to the anchor dock having a pivotal trough formed on one side thereof and anchor apertures formed on another side normal to and communicating with the pivotal trough, the pivotal trough pivotally housing a pivotal axle which has an anchor plane and anchor struts, each anchor aperture housing an anchor element and an elastic element, the anchor element having one end engaged with the hole of the anchor dock;

a door clamp means for clamping the glass door including a holding clip with a cutaway notch formed thereon and a clamp clip, the notch of the holding clip having an upper side and a lower side with a trough formed respectively thereon corresponding to each other and a vertical side with a plurality of coupling holes formed thereon, the trough of the holding clip being pivotally coupled with the anchor strut of the pivotal axle such that the glass door is pivotally turnable on the support member; and a pad element having an arched surface and a plurality of stubs located on the arched surface to engage with the coupling holes of the holding clip;

wherein the support member and the door clamp means that hold the glass door form a closed and tight contact therebetween to prevent water in the shower stall from splashing and seeping outside the shower stall and keep surroundings outside the shower stall dry, and the pad element prevents the door clamp means from directly hitting the support member so as to avoid damaging scratches from occurring on the surface of the support member.

2. The waterproof hinge structure of claim 1 further having a plug coupled with each of two ends of the pivotal axle adjoining the support member.

3. The waterproof hinge structure of claim 1, wherein the plug has a cylindrical and hollow shaft and a retaining surface extended from one end thereof.

4. The waterproof hinge structure of claim 1, wherein the arched surface of the pad element has two sides each extended to form a bulged rim.

5. The waterproof hinge structure of claim 1, wherein the pad element is made from an elastic material.

6. The waterproof hinge structure of claim 5, wherein the elastic material is rubber.

* * * * *